US007735830B2

(12) United States Patent
Shackleford

(10) Patent No.: US 7,735,830 B2
(45) Date of Patent: Jun. 15, 2010

(54) CARD GAME ALLOWING REDEALS

(75) Inventor: Michael Shackleford, Las Vegas, NV (US)

(73) Assignee: Wizard of Odds Consulting, Inc, Las Vegas, NV (US)

( * ) Notice: Subject to any disclaimer, the term of this patent is extended or adjusted under 35 U.S.C. 154(b) by 40 days.

(21) Appl. No.: 11/566,679

(22) Filed: Dec. 4, 2006

(65) Prior Publication Data

US 2008/0073844 A1 Mar. 27, 2008

Related U.S. Application Data

(60) Provisional application No. 60/826,909, filed on Sep. 26, 2006.

(51) Int. Cl.
*A63F 1/00* (2006.01)

(52) U.S. Cl. ..... 273/274; 273/292

(58) Field of Classification Search ..... 273/274, 273/292; 463/12, 13

See application file for complete search history.

(56) References Cited

U.S. PATENT DOCUMENTS 4,743,022 A * 5/1988 Wood ..... 463/13
6,206,780 B1 * 3/2001 Awada ..... 463/13
6,537,150 B1 * 3/2003 Luciano et al. ..... 463/16
7,222,856 B2 * 5/2007 Dodge ..... 273/292
2004/0262844 A1 * 12/2004 Manzo et al. ..... 273/292
2006/0046816 A1 * 3/2006 Walker et al. ..... 463/13
2006/0113729 A1 * 6/2006 Dodge ..... 273/292
2007/0129147 A1 * 6/2007 Gagner ..... 463/42

OTHER PUBLICATIONS http://wizardofodds.com/threecard2ndchance, website, Three Card 2nd Chance Poker, Jul. 2008.* http://wizardofodds.com/mulliganpoker, website, Five-Card Mulligan Poker, May 2007.* http://www.essortment.com/hobbies/carddrawpoke_tvss.htm, Website 5 Card Draw Poker Rules and Strategy, 2002.* http://www.mcglaun.com/tricksrules.htm, Rules of Tricks, game by Ayman Khouri, 1984.*

* cited by examiner

*Primary Examiner*—William M Pierce
(74) *Attorney, Agent, or Firm*—Muskin & Cusick LLC

(57) ABSTRACT

A wagering game that allows the player and/or the dealer a redeal. If the player doesn't like his or her hand, the player can discard the player's hand and receive a new set of cards. If the dealer doesn't like his or her hand, according to predetermined dealer criteria, then the dealer can discard the dealer's hand and receive a new set of cards. The highest hand wins. The player can also have the opportunity to make a bonus bet.

15 Claims, 2 Drawing Sheets

CARD GAME ALLOWING REDEALS

CROSS REFERENCE TO RELATED APPLICATIONS

This application claims benefit to provisional application 60/826,909, filed on Sep. 26, 2006, which is incorporated by reference herein in its entirety.

BACKGROUND OF THE INVENTION

1. Field of the Invention

The present inventive concept relates to a wagering game, and more particularly to a game which allows the player and/or the dealer to have redeals.

2. Description of the Related Art

Casino table games related to poker are a currently a hot industry. Casinos are always looking for new and exciting table games which can increase the casino's revenue and also provide a more exciting game for the players then the current set of games.

SUMMARY OF THE INVENTION

It is an aspect of the present invention to provide an exciting wagering game.

The above aspects can be obtained by a method that includes (a) receiving an ante wager and a bonus wager from a player; (b) dealing a player's hand; (c) dealing a dealer's hand; (d) allowing the player to view the player's hand and offering to redeal the player's hand at the player's option; and (e) determining who has a higher ranking hand, the player's hand or the dealer's hand, wherein if the dealer has the higher ranking hand, then taking the ante wager, and if the player has the higher ranking hand then paying the ante wager.

The above aspects can also be obtained by a computer readable storage medium to control a computer to perform a method to play a wagering game, the method including (a) receiving an ante wager and a bonus wager from a player; (b) dealing a player's hand; (c) dealing a dealer's hand; (d) allowing the player to view the player's hand and offering to redeal the player's hand at the player's option; and (e) determining who has a higher ranking hand, the player's hand or the dealer's hand, wherein if the dealer has the higher ranking hand, then taking the ante wager, and if the player has the higher ranking hand then paying the ante wager.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
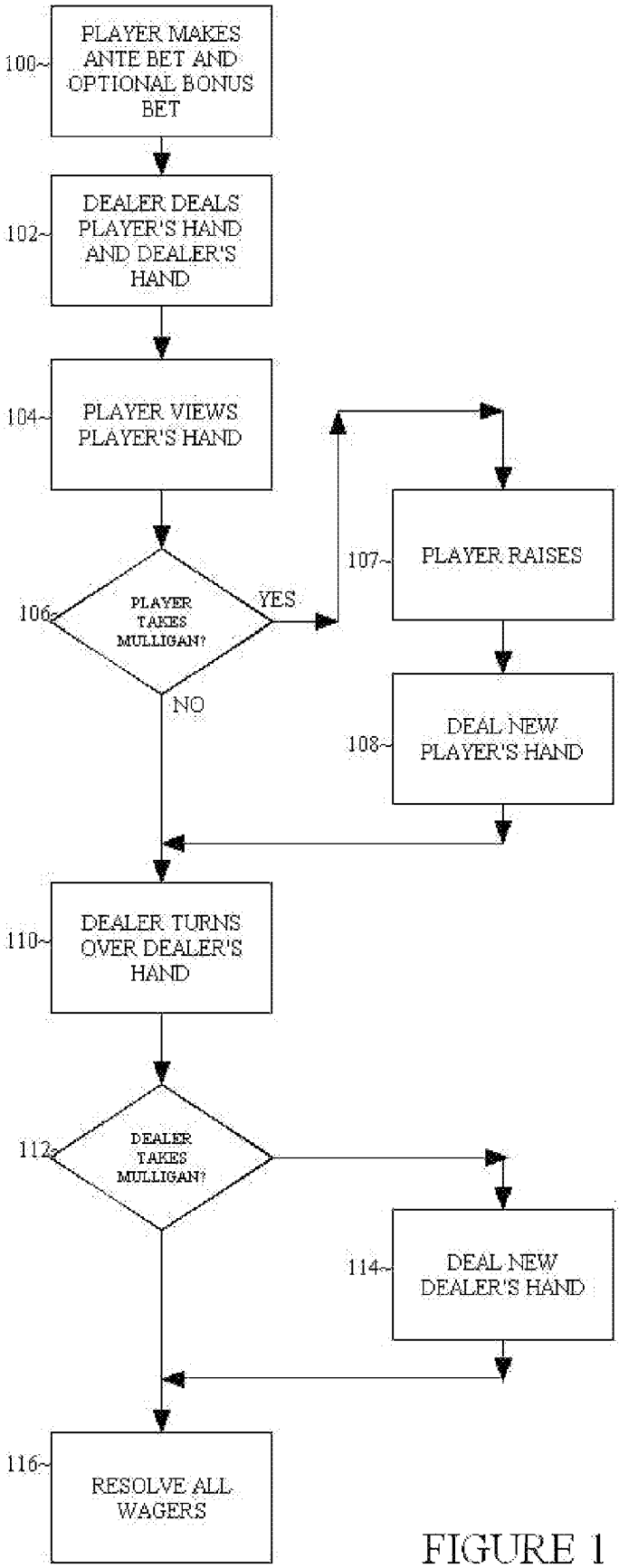
FIG. 1 is an exemplary flowchart illustrating a method to implement a wagering game involving redeals, according to an embodiment.

Reference will now be made in detail to the presently preferred embodiments of the invention, examples of which are illustrated in the accompanying drawings, wherein like reference numerals refer to like elements throughout.

The present general inventive concept relates to a method, system, and computer readable storage which allows a casino to offer a table game in which the player can take a "mulligan." A mulligan is when the player does not like his or her hand, the player can discard the entire hand and receive a brand new hand. The dealer may also be given the option to take a mulligan as well. When a player takes a mulligan the player must discard the entire hand, not just parts of it.

Table I below illustrates an exemplary set of rules for a one card embodiment.

TABLE I

1. One to eight 52-card decks are used. The highest card is an ace, then king, queen, etc . . . , with the lowest card a 2.
2. Multiple players may play at the same time but the cards should be shuffled between hands.
3. Play starts with the player making an ante bet.
4. The dealer shall give each player one card and himself one card. All cards will be dealt face down. The player may examine his own card but sharing information should be discouraged.
5. The player has the choice to stand or take a Mulligan.
6. If the player chooses to stand he should tuck his card under his ante bet.
7. If the player chooses to take a Mulligan he should discard his card and should make a raise wager, equal and next to the ante wager.
8. The dealer will give one new card to any player taking a Mulligan.
9. The dealer will then turn over his card.
10. If the dealer has a 9 or higher then he will stand.
11. If the dealer has an 8 or less the dealer will take a Mulligan, discarding his card for a new card.
12. The dealer will compare his own card to the player's card, the higher card wins. If the dealer has the higher card then the player will lose the ante and raise wager, if made. If the player has the higher card both ante and raise will pay according to the ante and raise pay table in table 1 below.

Table II below illustrates an exemplary paytable for the one card embodiment.

TABLE II

Ante and Raise Pay Table

| Event | Pays |
|---|---|
| Player has ace, dealer has a 2 | 6 to 1 |
| Player has an ace, dealer has 3 to king | 3 to 2 |
| Player wins with king or less | 1 to 1 |

The optimal player strategy is to mimic the dealer, switching with a 2 to 8, and standing with 9 to ace.

Examples of the one card embodiments will now be presented:

Joe bets $1 on the ante and is then dealt a nine of hearts. Joe decides to stand. The dealer then reveals the dealer's card which turns out to be a queen of diamonds. The dealer stands. The dealer wins since the queen is higher than the nine. Thus, Joe loses his $1 ante bet.

As a further example, Joe bets $1 on the ante and is then dealt a nine of hearts. Joe decides to stand. The dealer then reveals the dealer's card which turns out to be a three of diamonds. The dealer replaces the dealer's card which turns out to be a five of hearts. The player wins since the nine is higher than the five. Thus, Joe wins $1 off his ante bet.

As a further example, Joe bets $1 on the ante and is then dealt a three of hearts. Joe decides to take a mulligan (raise), and places a $1 raise wager. The dealer then replaces Joe's three of hearts with a new card, a jack of spades. The dealer then reveals the dealer's card which turns out to be a three of diamonds. The dealer replaces the dealer's card which turns out to be a five of hearts. The player wins since the jack is higher than the five. Thus, Joe loses win $1 off his ante bet and $1 off the raise bet for a total profit of $2.

As a further example, Joe bets $1 on the ante and is then dealt a three of hearts. Joe decides to take a mulligan (raise), and places a $1 raise wager. The dealer then replaces Joe's three of hearts with a new card, an ace of spades. The dealer then reveals the dealer's card which turns out to be a ten of diamonds. The player wins since the ace is higher than the ten. Thus, Joe loses win $1.50 off his ante bet and $1.50 off the raise bet for a total profit of $2.50. The player wins $1.50 off the ante bet and the raise bet because the player had an ace and the dealer had a ten (see Table II).

In a further embodiment, three card hands can be formed. Table III below illustrates an exemplary set of rules for an embodiment using three cards.

TABLE III

1. A single 52-card deck is used. All hands are scored according to conventional poker rules.
2. One to seven players may play at a time. The dealer runs the risk of running out of cards with eight or more players.
3. Play starts with the player making an ante bet. The player may optionally make a bonus bet as well.
4. The dealer shall give each player three cards and himself three cards. All cards will be dealt face down. The player may examine his own cards but sharing information should be discouraged.
5. The player has the choice to stand or take a Mulligan.
6. If the player chooses to stand he should tuck his cards under his ante bet.
7. If the player chooses to take a Mulligan he should discard his cards and should make a raise wager, equal and next to the ante wager.
8. If the player takes a Mulligan he shall immediately lose his bonus bet, if made.
9. The dealer will give three new cards to any player taking a Mulligan.
10. The dealer will then turn over his cards.
11. If the dealer has a king high or higher then he will stand.
12. If the dealer has a queen high or less the dealer will take a Mulligan, discarding his hand for three new cards.
13. The dealer will compare his own hand to the player's hand, the higher hand wins. If the dealer has the higher hand the player will lose the ante and raise wager, if made. If the player has the higher hand both ante and raise will pay according to the ante and raise pay table in Table IV below.
14. Due to the different probabilities using three cards than five cards then hand order shall be different than conventional poker. The following is the hand order for this game, from highest to lowest.
    1. Straight flush
    2. Three of a kind
    3. Straight
    4. Flush
    5. Pair
    6. All other
15. The bonus bet shall pay according to one of the pay tables in Table V below. All bonus bet wins are on a "for one" basis, in other words the player keeps his original bet if he wins.

Table IV below illustrates an exemplary ante and raise paytable for the three card embodiment.

TABLE IV

Ante and Raise Pay Table

| Hand | Pays |
|---|---|
| Straight flush | 6 to 1 |
| Three of a kind | 4 to 1 |

TABLE IV-continued

Ante and Raise Pay Table

| Hand | Pays |
|---|---|
| Straight | 3 to 2 |
| All other | 1 to 1 |

Table V below illustrates an exemplary bonus bet paytable for the three card embodiment.

TABLE V

Bonus Bet Pay Table

| Hand | Pay Table A | Pay Table B | Pay Table C | Pay Table D |
|---|---|---|---|---|
| Straight flush | 75 | 80 | 75 | 70 |
| Three of a kind | 60 | 50 | 50 | 50 |
| Straight | 10 | 10 | 10 | 10 |
| Flush | 5 | 5 | 5 | 5 |

Table VI below shows all possible outcomes of the ante and raise bets, assuming optimal player strategy, for the three card embodiment.

TABLE VI

| Event | Pays | Combinations | Probability | Return |
|---|---|---|---|---|
| Player wins with nothing, bet of 1 | 1 | 980988 | 0.112301 | 0.112301 |
| Player wins with pair, bet of 1 | 1 | 1116969 | 0.127868 | 0.127868 |
| Player wins with flush, bet of 1 | 1 | 395201 | 0.045242 | 0.045242 |
| Player wins with straight, bet of 1 | 1.5 | 275823 | 0.031575 | 0.047363 |
| Player wins with three of a kind, bet of 1 | 4 | 20420 | 0.002338 | 0.009351 |
| Player wins with straight flush, bet of 1 | 6 | 19010 | 0.002176 | 0.013057 |
| Player wins with nothing, bet of 2 | 2 | 728431 | 0.083389 | 0.166778 |
| Player wins with pair, bet of 2 | 2 | 561474 | 0.064276 | 0.128552 |
| Player wins with flush, bet of 2 | 2 | 198015 | 0.022668 | 0.045336 |
| Player wins with straight, bet of 2 | 3 | 137936 | 0.015791 | 0.047372 |
| Player wins with three of a kind, bet of 2 | 8 | 10395 | 0.001190 | 0.009520 |
| Player wins with straight flush, bet of 2 | 12 | 9475 | 0.001085 | 0.013016 |
| Player loses with bet of 1 | −1 | 1532045 | 0.175384 | −0.175384 |
| Player loses with bet of 2 | −2 | 2739547 | 0.313616 | −0.627232 |
| Player ties with bet of 1 | 0 | 5286 | 0.000605 | 0.000000 |
| Player ties with bet of 2 | 0 | 4342 | 0.000497 | 0.000000 |
| Total | | 8735357 | 1.000000 | −0.036862 |

The lower right cell in Table VI shows a house edge of 3.69%. This is the ratio of the expected player loss to the original wager. The player will raise 50.25% of the time, for an average wager of 1.5025 units. The element of risk, defined as the ratio of the expected loss to the average wager, is 2.45%.

The highest hand the player should switch on for the three card embodiment described above is king, 9, 8.

Examples of the three card embodiment will now be presented.

Onalisa places a $1 ante wager and a $2 bonus bet wager. The dealer then deals Onalisa a ten diamonds, jack clubs, ten of hearts. The player decides to stand. The dealer now reveals the dealer's hand to reveal a three spades, ten diamonds, king clubs. Since the dealer has at least a king high, the dealer does not take a mulligan. The player's hand (pair of tens) is higher than the dealer's hand (king high). Thus, the player wins $1 on the ante wager. Onalisa's hand does not comprise a winning hand for the bonus bet (see Table V), so Onalisa loses the $2 bonus bet wager. Thus, Onalisa has lost $1.

Onalisa places a $2 ante wager and a $1 bonus bet wager. The dealer then deals Onalisa a ten diamonds, jack clubs, ten of hearts. The player decides to stand. The dealer now reveals the dealer's hand to reveal a three spades, ten diamonds, jack clubs. Since the dealer does not have at least a king high, the dealer takes a mulligan. Thus, the dealer's original hand is discarded and the dealer deals himself a new hand: Ace spades, three hearts, four diamonds. The player's hand (pair of tens) is higher than the dealer's hand (Ace high). Thus, the player wins $2 on the ante wager. Onalisa's hand does not comprise a winning hand for the bonus bet (see Table V), so Onalisa loses the $1 bonus bet wager. Thus, Onalisa has a net win of $1.

Onalisa places a $1 ante wager and a $2 bonus bet wager. The dealer then deals Onalisa a ten diamonds, jack clubs, nine of hearts. The player decides to take a mulligan, and places an additional $1 raise wager. Because she has taken a mulligan, Onalisa has lost the $2 bonus bet wager (this can be taken by the dealer now or at a later time) The dealer now deals the player's new hand, which is: Ace hearts, Ace clubs, Ace diamonds. The dealer now reveals the dealer's hand to reveal a three spades, ten diamonds, king clubs. Since the dealer has at least a king high, the dealer does not take a mulligan. The player's hand (three aces) is higher than the dealer's hand (king high). Thus, the player wins $4 on the ante wager.

Onalisa places a $1 ante wager and a $2 bonus bet wager. The dealer then deals Onalisa a ten diamonds, ten clubs, ten of hearts. Onalisa decides to stand. The dealer now reveals the dealer's hand to reveal a three spades, four hearts diamonds, king clubs. Since the dealer has at least a king high, the dealer does not take a mulligan. The player's hand (three tens) is higher than the dealer's hand (king high). Thus, the player wins $4 on the ante wager (since the player has three of a kind, see Table IV). Onalisa also wins $120 on the bonus wager (assuming the casino used paytable A from Table V). Thus, Onalisa has a net win of $124.

In a further embodiment, a five card embodiment can be implemented. Table VII below illustrates an exemplary set of rules for a five card embodiment.

TABLE VII

1. A single 52-card deck is used. All hands are scored according to conventional poker rules.
2. One to four players may play at a time. The dealer runs the risk of running out of cards with five or more players.
3. Play starts with the player making an ante bet. The player may optionally make a bonus bet as well.
4. The dealer shall give each player five cards and himself five cards. All cards will be dealt face down. The player may examine his own cards but sharing information should be discouraged.
5. The player has the choice to stand or take a Mulligan.
6. If the player chooses to stand he should tuck his cards under his ante bet.
7. If the player chooses to take a Mulligan he should discard his cards and should make a raise wager, equal and next to the ante wager.
8. If the player takes a Mulligan he shall immediately lose his bonus bet, if made.
9. The dealer will give five new cards to any player taking a Mulligan.
10. The dealer will then turn over his cards.
11. If the dealer has an ace high or higher he will stand.
12. If the dealer has a king high or less the dealer will take a Mulligan, discarding his hand for five new cards.
13. The dealer will compare his own hand to the player's hand, the higher hand wins. If the dealer has the higher hand the player will lose the ante and raise wager, if made. If the player has the higher hand both ante and raise will pay according to the ante and raise pay table in Table VIII below.
14. The bonus bet shall pay according to one of the pay tables in Table IX below.

Table VIII below illustrates an exemplary ante and raise paytable that can be used for the five card version.

TABLE VIII

Ante and Raise Pay Table

| Hand | Pays |
|---|---|
| Royal flush | 100 to 1 |
| Straight flush | 50 to 1 |
| Four of a kind | 10 to 1 |
| Full house | 3 to 1 |
| All other | 1 to 1 |

Table IX below illustrates exemplary bonus bet paytables for use with the five card version.

TABLE IX

Bonus Bet Pay Table

| Hand | Pay Table A | Pay Table B | Pay Table C | Pay Table D | Pay Table E | Pay Table F | Pay Table G |
|---|---|---|---|---|---|---|---|
| Royal flush | 10000 to 1 | 10000 to 1 | 10000 to 1 | 10000 to 1 | 10000 to 1 | 10000 to 1 | 10000 to 1 |
| Straight flush | 1000 to 1 | 1000 to 1 | 1000 to 1 | 1000 to 1 | 1000 to 1 | 1000 to 1 | 1000 to 1 |
| Four of a kind | 200 to 1 | 250 to 1 | 200 to 1 | 250 to 1 | 200 to 1 | 200 to 1 | 200 to 1 |
| Full house | 100 to 1 | 100 to 1 | 100 to 1 | 80 to 1 | 80 to 1 | 75 to 1 | 80 to 1 |
| Flush | 50 to 1 | 50 to 1 | 50 to 1 | 50 to 1 | 50 to 1 | 50 to 1 | 50 to 1 |
| Straight | 30 to 1 | 25 to 1 | 25 to 1 | 25 to 1 | 25 to 1 | 25 to 1 | 20 to 1 |
| Three of a kind | 10 to 1 | 10 to 1 | 10 to 1 | 10 to 1 | 10 to 1 | 10 to 1 | 10 to 1 |
| Two pair | 5 to 1 | 5 to 1 | 5 to 1 | 5 to 1 | 5 to 1 | 5 to 1 | 5 to 1 |

Table X below shows all possible outcomes of the ante and raise bets, assuming optimal player strategy, for the five card embodiment.

TABLE X

| Event | Pays | Combinations | Probability | Return |
|---|---|---|---|---|
| Player wins with nothing, bet of 1 | 1 | 335,479,548 | 0.015127 | 0.015127 |
| Player wins with pair, bet of 1 | 1 | 5,835,579,664 | 0.263124 | 0.263124 |
| Player wins with a two pair, bet of 1 | 1 | 982,017,843 | 0.044279 | 0.044279 |
| Player wins with a three of a kind, bet of 1 | 1 | 459,549,714 | 0.020721 | 0.020721 |
| Player wins with straight, bet of 1 | 1 | 86,542,945 | 0.003902 | 0.003902 |
| Player wins with flush, bet of 1 | 1 | 43,374,459 | 0.001956 | 0.001956 |
| Player wins with full house, bet of 1 | 3 | 32,148,939 | 0.001450 | 0.004349 |
| Player wins with four of a kind, bet of 1 | 10 | 5,392,577 | 0.000243 | 0.002431 |
| Player wins with straight flush, bet of 1 | 50 | 307,507 | 0.000014 | 0.000693 |
| Player wins with royal flush, bet of 1 | 100 | 33,978 | 0.000002 | 0.000153 |
| Player wins with nothing, bet of 2 | 2 | 569,984,696 | 0.025700 | 0.051401 |
| Player wins with pair, bet of 2 | 2 | 2,640,619,835 | 0.119065 | 0.238129 |
| Player wins with a two pair, bet of 2 | 2 | 438,019,584 | 0.019750 | 0.039500 |
| Player wins with a three of a kind, bet of 2 | 2 | 202,130,515 | 0.009114 | 0.018228 |
| Player wins with straight, bet of 2 | 2 | 39,068,971 | 0.001762 | 0.003523 |
| Player wins with flush, bet of 2 | 2 | 19,721,951 | 0.000889 | 0.001779 |
| Player wins with full house, bet of 2 | 6 | 13,977,666 | 0.000630 | 0.003781 |
| Player wins with four of a kind, bet of 2 | 20 | 2,279,881 | 0.000103 | 0.002056 |
| Player wins with straight flush, bet of 2 | 100 | 138,179 | 0.000006 | 0.000623 |
| Player wins with royal flush, bet of 2 | 200 | 15,664 | 0.000001 | 0.000141 |
| Player loses with bet of 1 | −1 | 4,364,807,557 | 0.196808 | −0.196808 |
| Player loses with bet of 2 | −2 | 6,105,750,953 | 0.275306 | −0.550612 |
| Player ties with bet of 1 | 0 | 463,097 | 0.000021 | 0.000000 |
| Player ties with bet of 2 | 0 | 630,724 | 0.000028 | 0.000000 |
| Total | | 22,178,036,447 | 1.000000 | −0.031523 |

The lower right cell shows a house edge of 3.15%. This is the ratio of the expected player loss to the original wager. The player will raise 45.24% of the time, for an average wager of 1.4524 units. The element of risk, defined as the ratio of the expected loss to the average wager, is 2.17%.

The highest hand the player should switch on for the above-described five card embodiment is an ace, king, 9, 5, and 3.

Examples of the five card embodiment will now be presented:

Rob places a $1 ante wager and a $2 bonus bet wager. The dealer then deals Rob a ten diamonds, jack clubs, ten of hearts, three diamonds, two spades. Rob decides to stand. The dealer now reveals the dealer's hand to reveal a three spades, ten diamonds, king clubs, King spades, five hearts. Since the dealer has at least an ace high (the dealer has a pair), the dealer does not take a mulligan. The player's hand (pair of tens) is lower than the dealer's hand (pair of kings). Thus, the player loses $1 on the ante wager. Rob's hand does comprise a winning hand for the bonus bet (see Table IX) since Rob has a pair, so Rob wins the 5:1 (assuming paytable A from Table IX) on the $2 bonus bet wager for a win of $10. Thus, Rob has won a net of $9.

As a further example, Rob places a $1 ante wager and a $2 bonus bet wager. The dealer then deals Rob a ten diamonds, jack clubs, nine of hearts, three diamonds, two spades. Rob decides to take a mulligan. Rob loses his bonus bet of $2 (see Table IX, paytable A) and makes a second bonus bet of $3 and is dealt a new hand of: three clubs, four diamonds, ten spades, nine diamonds, king clubs. The dealer now reveals the dealer's hand to reveal a three spades, ten diamonds, two clubs, King spades, five hearts. Since the dealer does not have at least an ace high, the dealer takes a mulligan. The dealer is now dealt: ace spades, two clubs, three diamonds, five hearts, four clubs. The player's hand (ten high) is lower than the dealer's hand (straight). Thus, the player loses $1 on the ante wager. Rob also loses his $3 on the second bonus bet since Rob's new hand with a rank of ten high is not a winning bonus payout (see Table IX, paytable A). Thus, Rob has lost a total of $6.

FIG. 1 illustrates an exemplary flowchart for implementing a wagering game allowing redeals, according to an embodiment.

The method can start with operation 100, wherein the player makes an ante wager and an optional bonus wager. The bonus wager may or may not be available to the player, depending on the embodiment being implemented. The bonus wager and the ante wager do not have to be equal amounts, although in an alternative embodiment they can be required to be equal amounts.

From operation 100, the method can proceed to operation 102, wherein the dealer deals a player's hand to the player and a dealer's hand to the dealer. The players hand and the dealers hand should be of an equal number of cards (e.g., the player gets 3 cards the dealer gets 3 cards, etc.), and the hands can comprise any number of cards (e.g., one card to 10 cards or more). The cards can be typically dealt face down. The dealer's hand can alternatively be dealt later on in the game, such as in operation 110.

From operation 102, the method proceeds to operation 104, wherein the player views the player's (his or her own) hand.

From operation 104, the method can proceed to operation 106, wherein the player decides whether or not to take a mulligan (a redeal). The player would typically decide whether to take a mulligan, if, after viewing his or her hand, the player isn't happy with it. If the player decides to take a mulligan, then the method can proceed to operation 107, wherein the player must raise. The raise should be equal to the original ante bet, although in an alternative embodiment, the raise does not have to be equal to the original ante bet (e.g., it can be 2× the ante, etc.) In a further embodiment, the player is not required to raise when the player takes a mulligan (e.g., operation 107 isn't performed).

In an embodiment, the casino may (or may not) also allow the player to make an optional (or required) second bonus bet when the player takes a mulligan, the bonus being paid on the player's new hand he or she is dealt (in operation 108). The paytable for the second bonus bet would typically be the same as the paytable for the first bonus bet (the bonus bet made in operation 100), although in a further embodiment a different paytable can be used for the second bonus bet.

From operation 107, the method can proceed to operation 108, wherein the dealer deals the player a replacement hand (which now becomes the player's hand, the player's hand dealt in operation 102 is discarded). Also, the player would lose his or her bonus bet if the player takes a mulligan (can be taken by the dealer now or at a later time, such as in operation 116). In an alternative embodiment, the player would not lose his or her bonus bet if the player takes a mulligan.

From operation 106 or operation 108, the method can proceed to operation 110, wherein the dealer turns over (reveals, or even deals) the dealer's hand.

From operation 110, the method can proceed to operation 112, which determines whether the dealer takes a mulligan (redeal). This can be determined according to predetermined rules, e.g., if the rank of the dealer's hand (the highest poker hand) is greater than a predetermined rank (or greater than or equal to a predetermined rank), then the dealer would not take a mulligan otherwise the dealer would take a mulligan. If the determination in operation 112 determines that the dealer takes a mulligan, then the method can proceed to operation 114, which deals a new dealer's hand (the dealers hand dealt previously is discarded). Whether the dealer takes a mulligan does not affect whether the player loses his or her bonus bet or not. In an alternative embodiment, if the dealer takes a mulligan, the player can lose his or her bonus bet (or it can be reduced, increased, or in some way affected, for example, using a different bonus paytable if the dealer takes a mulligan).

From operation 112 or operation 114, the method can proceed to operation 116, which resolves all wagers (e.g., ante wager, raise wager, bonus wager), according to predetermined rules. The bonus wager is paid according to a predetermined paytable based on the original player hand (dealt in operation 102). If the player took a mulligan, then in an embodiment, the player would lose the bonus wager. The ante wager and raise wager are determined based on which player (the player or the dealer) has a better poker hand. If the dealer has a better hand, then the player loses both the ante wager and the raise wager (if placed). If the player has a better hand, then the player wins the ante wager and the raise wager (if placed) and based on a rank of the player's hand, and the wins a payout on these wagers using a paytable.

Note that the operations in FIG. 1 can be performed in any order. For example, in an embodiment, the dealer can decide whether to take a mulligan (redeal) before the player does. The cards can be dealt and revealed in any order. Wagers can also be placed and resolved in any order.

Figure 2:
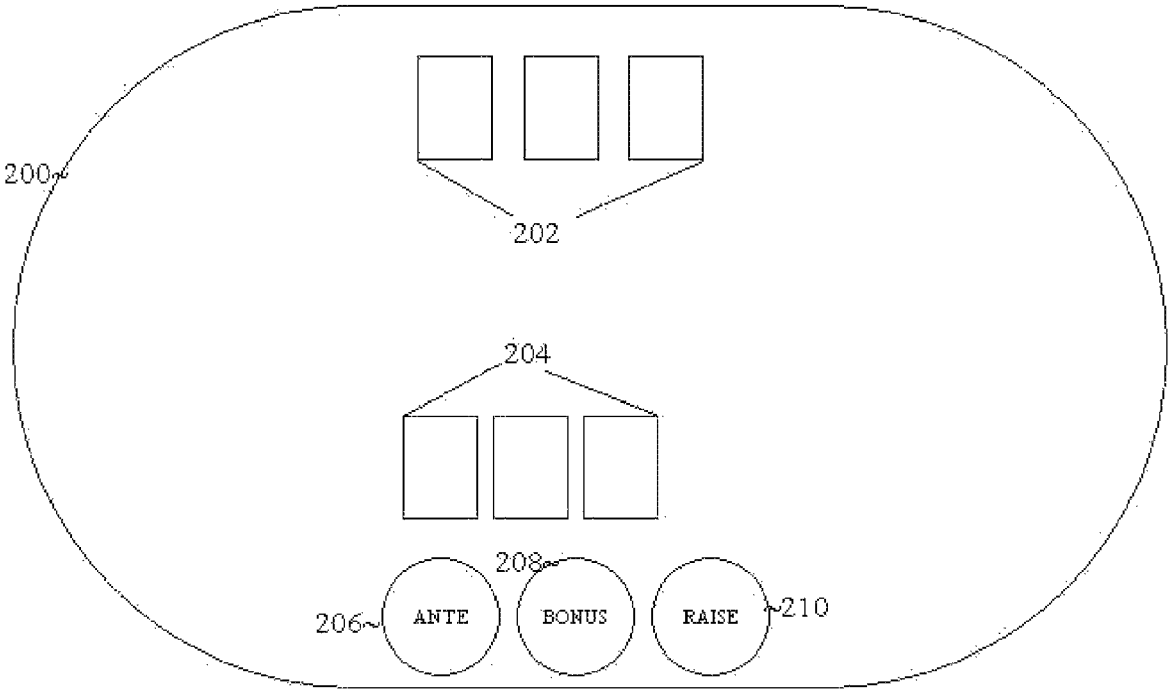
FIG. 2 is an exemplary table layout which can be used to implement a wagering game involving redeals, according to an embodiment.

FIG. 2 is an exemplary table layout which can be used to implement a wagering game involving redeals, according to an embodiment.

FIG. 2 illustrates a table 200 for one person, although of course a table can accommodate any number of players (e.g., 1-10 or more). A dealer's hand 202 and a player's hand 204 are on the table. An ante betting circle 206 is where the player can place his or her ante wager, a bonus betting circle 208 is where the player can place his or her bonus wager, and a raise betting circle 210 is where the player can place his or her raise wager. Of course, these betting circles can appear in any order, can appear in any configuration and can even be optional. Each player at the table can have their own set of betting circles.

Any embodiments described herein can be played with a standard deck of cards or any type of special deck (e.g. a Spanish deck, etc.) The game can also be played with a single deck or multiple decks (e.g. 1-8 decks or more). Poker hands can be ranked as known in the art or as described herein. Further, the order of any of the operations described herein can be performed in any order and wagers can be placed/resolved in any order. Any operation described herein can also be optional. Any embodiments herein can also be played in electronic form and programs and/or data for such can be stored on any type of computer readable storage medium (e.g. CD-ROM, DVD, disk, etc.)

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method to play a wagering game, the method comprising:

providing a physical deck(s) of cards;

receiving an ante wager and a bonus wager from a player on a table;

dealing, from the deck(s), a player's hand comprising at least three cards;

dealing, from the deck(s), a dealer's hand comprising at least three cards;

allowing the player to view the player's hand and receiving a choice from the player of one out of only the two following options: 1) redeal the player's hand in its entirety; 2) not draw any new cards, but not allowing the player to replace less than all cards in the player's hand; and determining who has a higher ranking hand, the player's hand or the dealer's hand, wherein, based on the determining, if the dealer has the higher ranking hand, then taking the ante wager from the player, and if the player has the higher ranking hand then paying the player a payout on the ante wager.

2. The method as recited in claim 1, further comprising, if the player exercises the redeal, then the player is required to make a raise wager.

3. The method as recited in claim 2, wherein if the player makes the raise wager then if the player wins the ante wager then the player also wins the raise wager.

4. The method as recited in claim 3, wherein the raise wager is paid at a same payout as the ante wager.

5. The method as recited in claim 2, wherein the raise wager must be equal in value to the ante wager.

6. The method as recited in claim 1, further comprising, before the dealing, receiving a bonus wager from the player, wherein if the player chooses to redeal then the player loses the bonus wager and if the player does not choose to redeal then the bonus wager is resolved based on the player's hand.

7. The method as recited in claim 1, wherein the player's hand and the dealer's hand each comprise one card.

8. The method as recited in claim 1, wherein the player's hand and the dealer's hand each comprise three cards.

9. The method as recited in claim 1, wherein the player's hand and the dealer's hand each comprise five cards.

10. The method as recited in claim 1, further comprising allowing the dealer to redeal the dealer's hand.

11. The method as recited in claim 10, wherein the dealer will redeal the dealer's hand if the dealer's hand meets predefined criteria.

12. The method as recited in claim 11, wherein the predefined criteria is if the dealer's hand has a poker rank greater than a particular hand.

13. The method as recited in claim 11, wherein the player's hand and the dealer's hand each comprise three cards, and the predefined criteria is if the dealer's hand is queen high or less.

14. The method as recited in claim 11, wherein the player's hand and the dealer's hand each comprise five cards, and the predefined criteria is if the dealer's hand is King high or less.

15. An electronic gaming apparatus configured to play a wagering game, the apparatus comprising:

a processor configured to execute instructions performing;

receiving an ante wager and a bonus wager from a player;

dealing a player's hand comprising at least three cards;

dealing a dealer's hand comprising at least three cards;

allowing the player to view the player's hand and receiving a choice from the player of one out of only the following two options: 1) redeal the player's hand in its entirety 2) not draw any new cards, but not allowing the player to replace less than all cards in the player's hand; and determining who has a higher ranking hand, the player's hand or the dealer's hand, wherein, based on the determining, if the dealer has the higher ranking hand, then taking the ante wager from the player, and if the player has the higher ranking hand then paying the player a payout on the ante wager; and a computer storage medium connected to the processor.

* * * * *